US008638041B2

(12) United States Patent
Takeuchi et al.

(10) Patent No.: US 8,638,041 B2
(45) Date of Patent: Jan. 28, 2014

(54) LIGHT-EMITTING ELEMENT DRIVE CIRCUIT SYSTEM, AND ELECTRONIC DEVICE

(75) Inventors: Takuya Takeuchi, Osaka (JP); Masanori Miyao, Osaka (JP)

(73) Assignees: Sanyo Electric Co., Ltd. (JP); Sanyo Semiconductor Co., Ltd. (JP); Sharp Kabushiki Kaisha (JP)

( * ) Notice: Subject to any disclaimer, the term of this patent is extended or adjusted under 35 U.S.C. 154(b) by 394 days.

(21) Appl. No.: 12/941,209

(22) Filed: Nov. 8, 2010

(65) Prior Publication Data

US 2011/0109240 A1 May 12, 2011

(30) Foreign Application Priority Data

Nov. 9, 2009 (JP) ..... 2009-256290

(51) Int. Cl.

| | |
|---|---|
| ***G05F 1/00*** | (2006.01) |
| ***H05B 37/02*** | (2006.01) |
| ***H05B 39/04*** | (2006.01) |
| ***H05B 41/36*** | (2006.01) |

(52) U.S. Cl.

USPC ..... 315/291; 315/302

(58) Field of Classification Search

None

See application file for complete search history.

(56) References Cited

U.S. PATENT DOCUMENTS

| | | | | |
|---|---|---|---|---|
| 2005/0134188 | A1* | 6/2005 | Lindqvist | 315/149 |
| 2005/0156836 | A1 | 7/2005 | Yoneyama et al. | |
| 2008/0185971 | A1 | 8/2008 | Kinoshita | |
| 2008/0238398 | A1 | 10/2008 | Yu et al. | |

FOREIGN PATENT DOCUMENTS

| | | | |
|---|---|---|---|
| CN | 1664900 | A | 9/2005 |
| CN | 1776488 | A | 5/2006 |
| CN | 1889805 | A | 1/2007 |
| CN | 1977301 | A | 6/2007 |
| JP | 11204273 | A * | 7/1999 |
| JP | 2001210478 | A | 8/2001 |
| JP | 2005-11895 | A | 1/2005 |

OTHER PUBLICATIONS

First Notice of Grounds for Rejection for Chinese Patent Application No. 201010540039.4, mailed Feb. 27, 2013, with English translation.

Notice of Grounds for Rejection for Japanese Patent Application No. 2009-256290, Date of Mailing: Jul. 23, 2013, with English translation.

* cited by examiner

*Primary Examiner* — Douglas W Owens
*Assistant Examiner* — Dedei K Hammond
(74) *Attorney, Agent, or Firm* — Cantor Colburn LLP

(57) ABSTRACT

A light-emitting element drive circuit system for driving a light-emitting element includes a current circuit section that drives the light-emitting element at a preset drive current value, and a current value setting section. The current value setting section sets the drive current value so that the drive current value is changed during a preset transition period from a first current value to a second current value that is not equal to the first current value, and changed during a preset transition period from the second current value to a third current value that is not equal to both the first current value and the second current value.

3 Claims, 8 Drawing Sheets

LIGHT-EMITTING ELEMENT DRIVE CIRCUIT SYSTEM, AND ELECTRONIC DEVICE

CROSS-REFERENCE TO RELATED APPLICATION(S)

This application claims priority to Japanese Patent Application No. 2009-256290, filed on Nov. 9, 2009, which is incorporated herein by reference in its entirety.

BACKGROUND OF THE INVENTION

1. Field of the Invention

The present invention relates to a light-emitting element drive circuit system and an electronic device, and more particularly to a light-emitting element drive circuit system for gradually changing luminance or the like of light-emitting elements, and an electronic device including such a light-emitting element drive circuit system.

2. Description of the Related Art

In recent years, light-emitting element drive circuit systems are provided in various electronic devices such as mobile phones. By causing the light-emitting elements to emit light (or to be turned ON), characters and patterns are displayed on LCD and other screens. In doing so, there are cases in which luminance and the like of light-emitting elements are gradually changed. In other words, the light-emitting elements are caused to emit light that changes in gradation.

As a related art of the present invention, JP 2005-11895 A discloses an LED drive circuit for driving an LED using a battery. The LED drive circuit includes a constant current circuit inserted on the anode side or the cathode side of an LED for controlling the current flowing through the LED to have a predetermined target value, and a resister connected on the cathode side of the LED and downstream of the constant current circuit. The LED drive circuit further includes a battery in which the voltage varies within a range including a predetermined voltage value and in accordance with the remaining available capacity, wherein the predetermined voltage value is a sum of a forward voltage decrease in the LED, a drive voltage in the constant current circuit when achieving the predetermined target value, and voltages at the two ends of the resistor when achieving the predetermined target value. The LED drive circuit also includes a booster circuit connected between the battery and the LED. When a switch provided inside the booster circuit is turned ON, the booster circuit boosts up the battery voltage to a magnitude greater than or equal to the predetermined voltage and outputs the boosted voltage, and, when the switch is turned OFF, the booster circuit outputs the battery voltage without changing. Further, the LED drive circuit includes a control circuit connected to the constant current circuit. The control circuit detects the magnitude relationship between the battery voltage and the predetermined voltage, and, only when the battery voltage becomes lower than the predetermined voltage, the control circuit turns on the switch inside the booster circuit.

Among light-emitting element drive circuit systems as shown in FIG. 7, there are drive circuit systems which serve to change the value of a light-emitting element drive current in order to cause a light-emitting element to emit light that changes in gradation (this current output from a gradation current circuit 90 is referred to as "a gradation current"). For example, as shown in FIG. 7, a reference current (Iref) output from a reference current circuit 20 is subjected to calculations in the gradation current circuit 90 and amplified in an LED driver circuit 60, so that a light-emitting element drive current as shown in FIG. 8 can be made to flow.

More specifically, in the gradation current circuit 90, calculation is performed according to the following arithmetic expression: Igra (output current from the gradation current circuit 90)=Agra*Iref*m/n, where Agra is an arbitrary constant, n is a predefined natural number, and m is 0, 1, 2, . . . n (transition period T is divided into n sections). Subsequently, in the LED driver circuit 60, amplification is performed according to the arithmetic expression ILED=ALED*Igra, where ALED is an arbitrary constant. As a result, over the duration of a predefined transition period T from time a1 to time a2, the current is varied linearly from current value 0 to current value ILED1. From time a2 to time a3, current value ILED1 is maintained. Furthermore, during the period from time a3 to time a4, the current is output while being varied linearly from current value ILED1 to current value 0. By performing a similar procedure, the light-emitting element drive current having the current characteristic as shown in FIG. 8 is also output during the period from time a4 to time a7.

In a case where a light-emitting element 8 is driven by the above-described light-emitting element drive circuit system, the current has a slope and is varied linearly during the periods from time a1 to time a2, from time a3 to time a4, from time a4 to time a5, and from time a6 to time a7 shown in FIG. 8. Accordingly, during these periods, the light-emitting element 8 emits light that changes in gradation; i.e., performs gradation emission. However, according to the light-emitting element drive circuit system shown in FIG. 7, gradation emission of the light-emitting element 8 can only be performed when the drive current value is caused to change from current value 0 to current value ILED1 (or current value ILED2), and from current value ILED1 (or current value ILED2) to current value 0. As it is impossible to perform gradation emission of the light-emitting element 8 when causing the drive current value to change from a first current value not equal to zero to a second current value that is not equal to both zero and the first current value, gradation emission may only be performed limitedly.

SUMMARY OF THE INVENTION

According to one aspect of the present invention, there is provided a light-emitting element drive circuit system for driving a light-emitting element. The light-emitting element drive circuit system includes a current circuit section that drives the light-emitting element at a preset drive current value, and a current value setting section. The current value setting section sets the drive current value so that the drive current value is changed during a preset transition period from a first current value to a second current value that is not equal to the first current value, and changed during a preset transition period from the second current value to a third current value that is not equal to both the first current value and the second current value.

An electronic device according to the present invention includes the above-described light-emitting element drive circuit system.

BRIEF DESCRIPTION OF THE DRAWINGS

Preferred embodiments of the present invention will be described in detail based on the following drawings, wherein.

DESCRIPTION OF PREFERRED EMBODIMENTS

Figure 1:
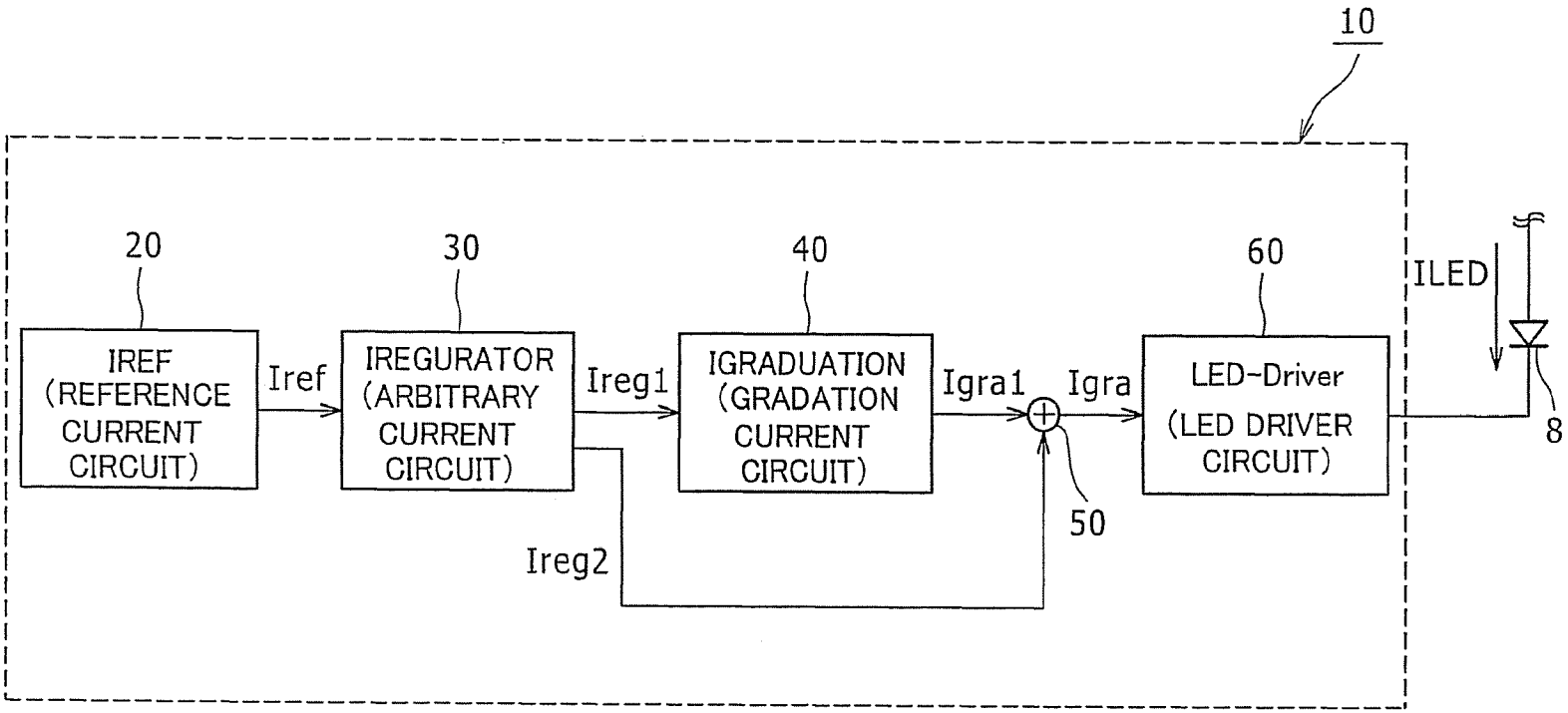
FIG. 1 is a diagram showing a light-emitting element drive circuit system according to an embodiment of the present invention.

An embodiment of the present invention will next be described in detail referring to the attached drawings. In the embodiment described below, when a plurality of light-emitting elements are provided to function as a backlight of an LCD screen of a mobile phone (in other words, cellular phone), while it is possible to employ a configuration such that every light-emitting element (LED) has a different color, LEDs having the same color may also be employed considering the fact that human vision is not very sensitive to the luminance of green LED (G-LED). For example, two green LEDs may be provided for one LED of each other color. It is also possible to increase the number of LEDs of a color other than green. Further, the size of increase may also be selected arbitrarily. A plurality of the LEDs functioning as the backlight of an LCD screen of a mobile phone may be connected in parallel to a single control. Moreover, the types, colors, number of colors, number of elements, and the like of the above-noted light-emitting elements can be changed as appropriate. In below, as the same elements are labeled with the same reference numerals throughout all of the drawings, explanations of the same elements will not be repeated and will simply be referred to as necessary using the reference numerals mentioned previously.

Figure 2A:
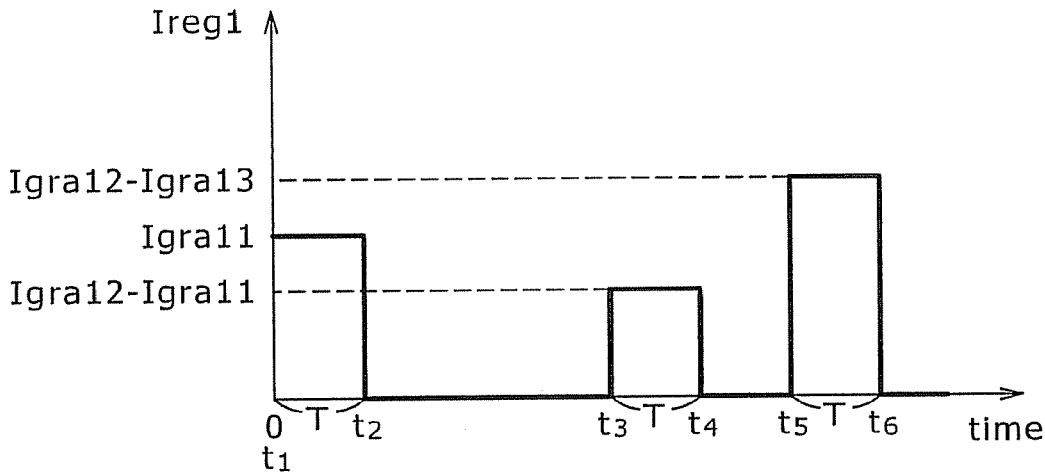
FIG. 2A is a diagram showing a characteristic of a first reference current (Ireg1) output from an arbitrary current circuit in the embodiment of the present invention.
Figure 2B:
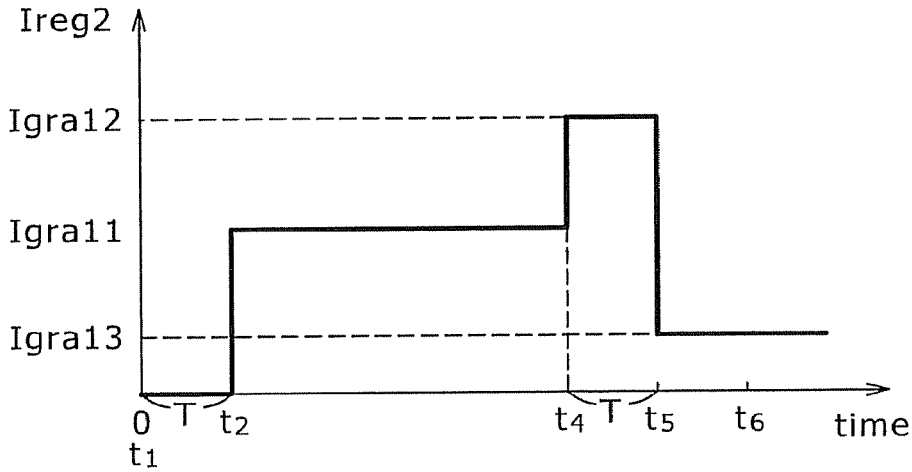
FIG. 2B is a diagram showing a characteristic of a second reference current (Ireg2) output from the arbitrary current circuit in the embodiment of the present invention.

FIG. 1 is a diagram showing a light-emitting element drive circuit system 10. FIG. 2A is a diagram showing a characteristic of a first reference current (Ireg1) output from an arbitrary current circuit 30. FIG. 2B is a diagram showing a characteristic of a second reference current (Ireg2) output from the arbitrary current circuit 30. FIG. 3A is a diagram showing a characteristic of a light-emitting element drive current (ILED) output from an LED driver circuit 60. FIG. 3B is a diagram showing a characteristic of a first gradation current (Igra1) output from a gradation current circuit 40. FIG. 3C is a diagram showing the characteristic of the second reference current (Ireg2) output from the arbitrary current circuit 30. FIG. 3D is a diagram showing a current being varied linearly. FIG. 3E is a diagram showing a current being varied according to a curve.

The light-emitting element drive circuit system 10 is configured to include a reference current circuit 20, an arbitrary current circuit 30, a gradation current circuit 40, and an LED driver circuit 60. The light-emitting element drive circuit system 10 has a function of causing a light-emitting element 8 to perform gradation emission (i.e., to emit light that changes in gradation). In the following description, the light-emitting element drive circuit system is explained as a system that is provided in a mobile phone and drives a light-emitting element 8 functioning as an LED illumination of the mobile phone.

The reference current circuit 20 is a constant current source that supplies a current having a predefined reference current value (Iref). The output from the reference current circuit 20 is input into the arbitrary current circuit 30.

The arbitrary current circuit 30 has a function of outputting a current by changing the current value to different values depending on respective time points. Specifically, based on the current output from the reference current circuit 20, the arbitrary current circuit 30 outputs a first reference current (Ireg1) and a second reference current (Ireg2) shown in FIGS. 2A and 2B. In the arbitrary current circuit 30, the first reference current (Ireg1) is obtained by performing calculations according to the arithmetic expression Ireg1=Areg1*Iref, where Areg1 denotes an arbitrary constant. Further, the second reference current (Ireg2) is obtained by performing calculations according to the arithmetic expression Ireg2=Areg2*Iref, where Areg2 denotes an arbitrary constant.

The first reference current (Ireg1) is such that, at time t1, the current value is changed from current value 0 (first current value) to a second current value (Igra11), and the second current value (Igra11) is maintained over the period from time t1 to time t2. Subsequently, at time t2, the current value is changed from the second current value (Igra11) to current value 0, and current value 0 is maintained from time t2 to time t3. Further, at time t3, the current value is changed from current value 0 to a fourth current value (Igra12−Igra11), and the fourth current value (Igra12−Igra11) is maintained from time t3 to time t4. Next, at time t4, the current value is changed from the fourth current value (Igra12−Igra11) to current value 0, and current value 0 is maintained from time t4 to time t5. Further, at time t5, the current value is changed from current value 0 to a fifth current value (Igra12−Igra13), and the fifth current value (Igra12−Igra13) is maintained from time t5 to time t6. At time t6, the current value is changed from the fifth current value (Igra12−Igra13) to current value 0.

The second reference current (Ireg2) is such that current value 0 (first current value) is maintained over the period from time t1 to time t2, and, at time t2, the current value is changed from current value 0 to the second current value (Igra11). Subsequently, the second current value (Igra11) is maintained from time t2 to time t4, and, at time t4, the current value is changed from the second current value (Igra11) to a third current value (Igr12). Further, the third current value (Igra12) is maintained from time t4 to time t5, and, at time t5, the current value is changed from the third current value (Igra12) to a sixth current value (Igra13). From time t5 to time t6, the sixth current value (Igra13) is maintained.

The gradation current circuit 40 has a function of calculating a first gradation current (Igra1) based on the first reference current (Ireg1) and outputting the first gradation current (Igra1). For each transition period during which the first gradation current (Igra1) should be varied linearly (i.e., each of the periods from time t1 to t2, from time t3 to t4, and from time t5 to t6; each of which referred to as "transition period T"), the gradation current circuit 40 performs calculations according to the arithmetic expression Igra1=Agra1*Ireg1*m/n, where Agra1 is an arbitrary constant, n is a predefined natural number, and m is 0, 1, 2, . . . n (transition period T is divided into n sections), and outputs the first gradation current (Igra1) as shown in FIG. 3B. Here, the term "linearly" as used in the above description "a current is varied linearly" is explained in detail referring to FIG. 3D. The term "linearly" as used herein actually refers to the state in which a stepwise control for achieving multiple levels is enhanced. To facilitate explanation, FIG. 3D shows eight levels only. By connecting the apexes of the respective steps in FIG. 3D, linearity can be illustrated. This means that, by increasing the number of levels to the utmost, linearity can be achieved. Further, while the description of the present embodiment refers to causing the current to be varied linearly, the present invention is not limited to varying the current in a linear manner, and the current may alternatively be varied according to a curve. The meaning of the term "curve" as used herein is explained referring to FIG. 3E. When a current is varied in stepwise form as shown in FIG. 3E, by connecting the apexes of the respective steps, a curve can be illustrated. This means that, by increasing the number of levels to the utmost, a curve can be achieved. Depending on the characteristics of the LEDs used, there may be cases in which it is desirable to vary the current in a curve in order to linearly change the brightness perceived by human vision. It should be noted that FIG. 3E simply shows one example in which a current is varied according a curve. Preferred curves would be different depending on the characteristics of the LEDs used, and FIG. 3E does not serve to limit the type of curve.

The first gradation current (Igra1) is such that, over the duration of the transition period T from time t1 to time t2, the current value is linearly changed from current value 0 (first current value) to the second current value (Igra11). At time t2, the current value is changed from the second current value (Igra11) to current value 0. Subsequently, from time t2 to time t3, current value 0 is maintained. Further, over the transition period T from time t3 to time t4, the current value is linearly changed from current value 0 to the fourth current value (Igra12−Igra11). At time t4, the current value is changed from the fourth current value (Igra12−Igra11) to current value 0, and current value 0 is maintained from time t4 to time t5. Further, at time t5, the current value is changed from current value 0 to the fifth current value (Igra12−Igra13). Over the transition period T from time t5 to time t6, the current value is linearly changed from the fifth current value (Igra12−Igra13) to current value 0.

An adder circuit 50 has a function of serially adding together the values of the first gradation current (Igra1) for respective time points and the second reference current (Ireg2) for the corresponding time points, and outputting the added current as a gradation current (Igra). Specifically, by adding together the first gradation current (Igra1) shown in FIG. 3B and the second reference current (Ireg2) shown in FIG. 3C, the adder circuit 50 obtains the gradation current (Igra) and outputs the gradation current (Igra) to the LED driver circuit 60. Here, the gradation current circuit 40 is referred to as "a first calculation circuit" that outputs the first gradation current (which is alternatively referred to as "a first serial current-setting data"). The arbitrary current circuit 30 is referred to as "a second calculation circuit" that outputs the second reference current (which is alternatively referred to as "a second serial current-setting data"). Further, a combination of the gradation current circuit 40, the arbitrary current circuit 30, and the adder circuit 50 is referred to as "a current value setting section."

The LED driver circuit 60 is a current circuit section that calculates, based on the gradation current (Igra), a light-emitting element drive current (ILED) (FIG. 3A) for driving the light-emitting element 8. Specifically, the LED driver circuit 60 has a function of obtaining the light-emitting element drive current (ILED) based on the arithmetic expression ILED=ALED*Igra (where ALED is an arbitrary constant) and driving the light-emitting element 8 at the drive current value shown in FIG. 3A.

Figure 3:
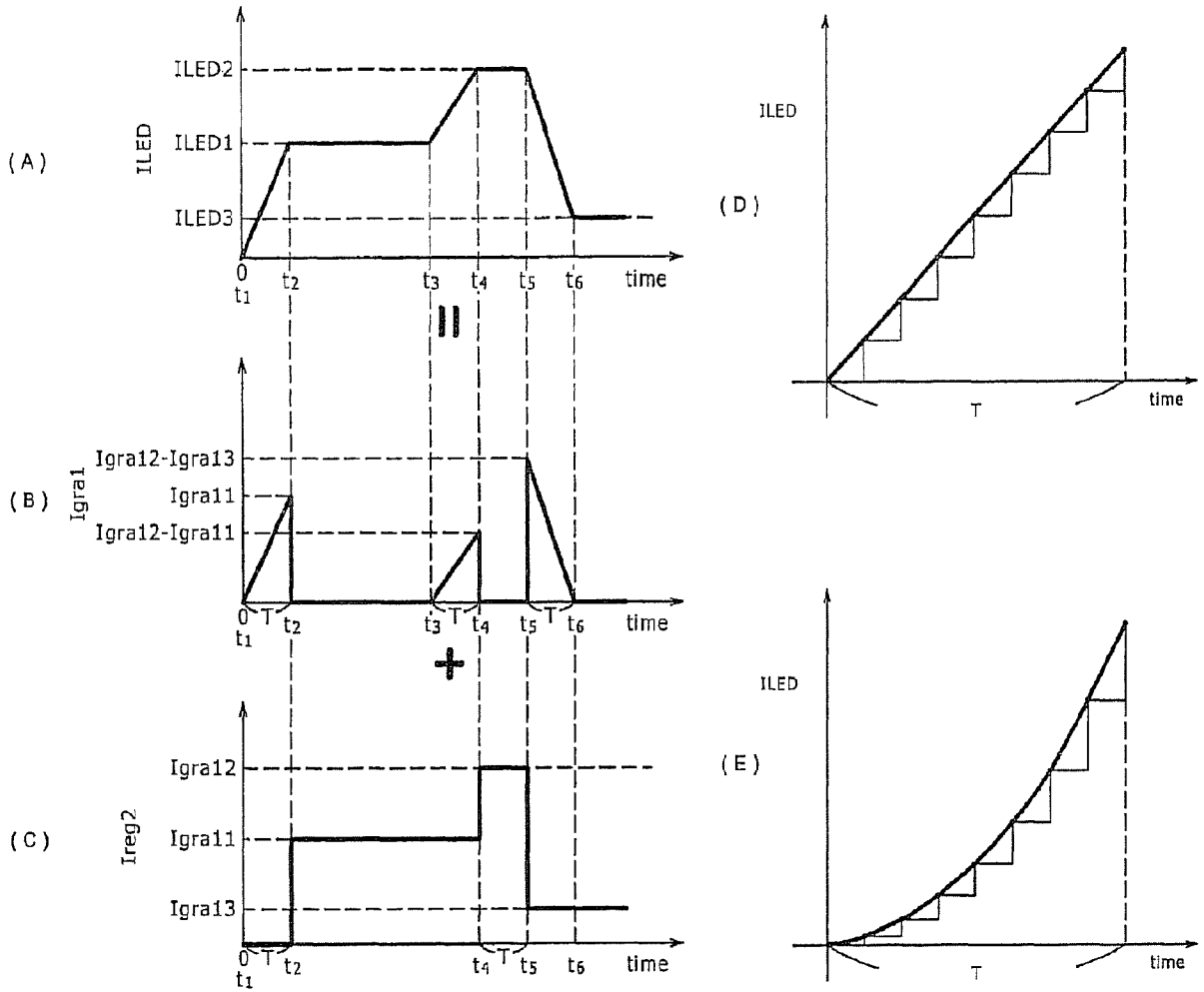
FIG. 3A is a diagram showing a characteristic of a light-emitting element drive current (ILED) output from an LED driver circuit in the embodiment of the present invention.
FIG. 3B is a diagram showing a characteristic of a first gradation current (Igra1) output from a gradation current circuit in the embodiment of the present invention.
FIG. 3C is a diagram showing the characteristic of the second reference current (Ireg2) output from the arbitrary current circuit in the embodiment of the present invention.
FIG. 3D is a diagram showing a current being varied linearly in the embodiment of the present invention.
FIG. 3E is a diagram showing a current being varied in a curve in the embodiment of the present invention.

The operation of the light-emitting element drive circuit system 10 having the above-described configuration is next explained referring to FIGS. 1-3. In the light-emitting element drive circuit system 10, a constant reference current value (Iref) is output from the reference current circuit 20. From the arbitrary current circuit 30, the first reference current (Ireg1) and the second reference current (Ireg2) are output. Next, from the gradation current circuit 40, the first gradation current (Igra1) based on the first reference current (Ireg1) is output. Subsequently, in the adder circuit 50, the values of the first gradation current (Igra1) (FIG. 3B) for respective time points and the values of the second reference current (Ireg2) (FIG. 3C) for the corresponding time points are serially added together and output as the gradation current (Igra). Further, the gradation current (Igra) is amplified by the LED driver circuit 60 so as to be changed into the light-emitting element drive current (ILED) (FIG. 3A), and the light-emitting element 8 is turned ON with the current value of the light-emitting element drive current (ILED) shown in FIG. 3A. Here, the light-emitting element drive current (ILED) shown in FIG. 3A is such that, over the period from time t1 to time t2, the current value is changed linearly from current value 0 to a current value ILED1 (not equal to current value 0), and then the current value ILED1 (not equal to zero) is maintained from time t2 to time t3. Further, over the period from time t3 to time t4, the current value is changed linearly from the current value ILED1 (not equal to zero) to a current value ILED2 (not equal to zero). In this manner, according to the light-emitting element drive circuit system 10, it is possible to linearly change the current value from an arbitrary current value to a different arbitrary current value. By means of such changes in the current value, the light-emitting element 8 can be caused to perform gradation emission, thereby enabling performance of gradation emission of light-emitting elements in a more desirable manner.

Next explained is a light-emitting element drive circuit system 11, which is a modified example of the light-emitting element drive circuit system 10. The light-emitting element drive circuit system 11 differs from the light-emitting element drive circuit system 10 in the output characteristics of the arbitrary current circuit 30, gradation current circuit 40, and LED driver circuit 60, and also in that the system 11 is provided with an additional gradation current circuit 80. The following explanation mainly focuses on these differences.

Figure 4:
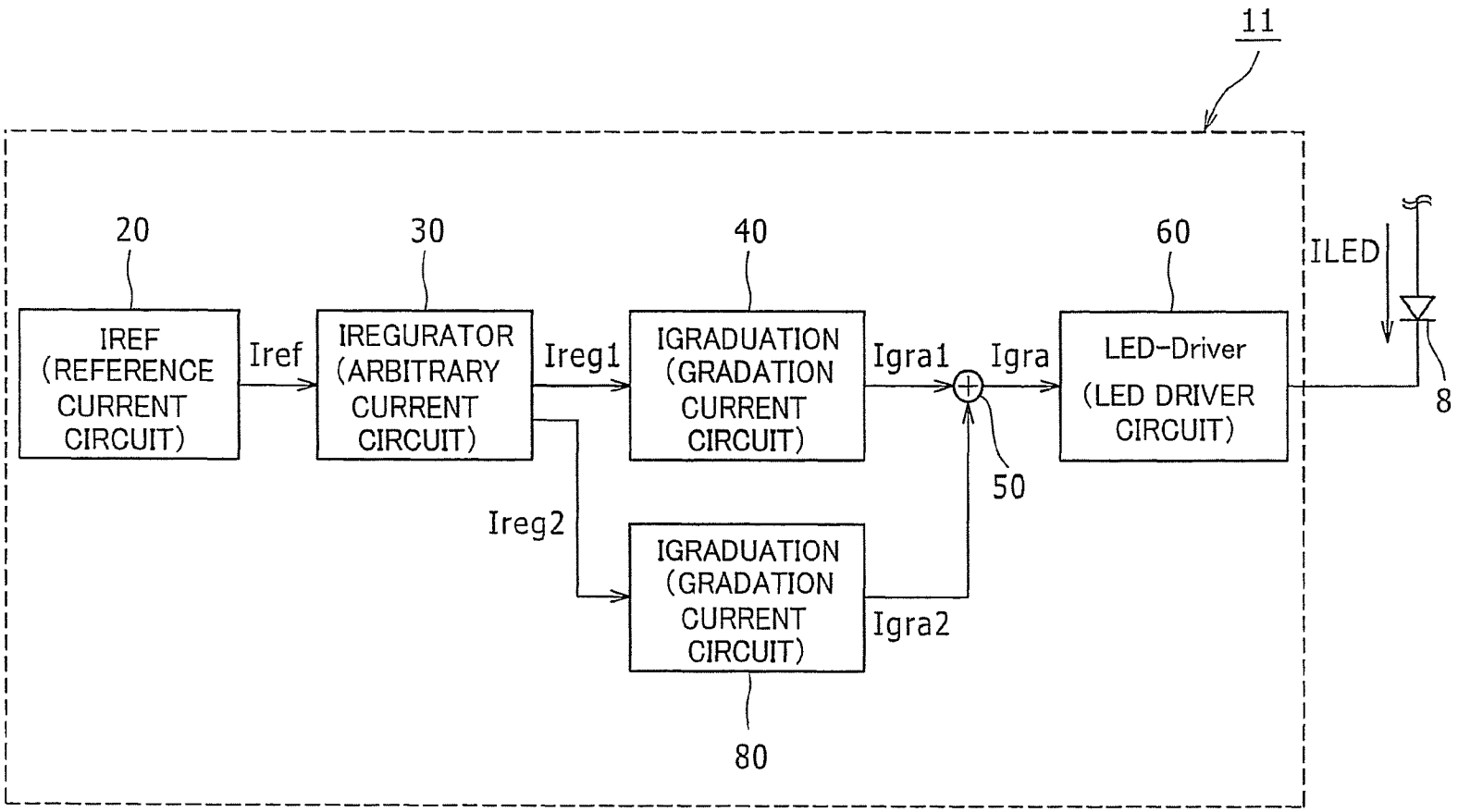
FIG. 4 is a diagram showing a light-emitting element drive circuit system according to a modified embodiment of the present invention.
Figure 5A:
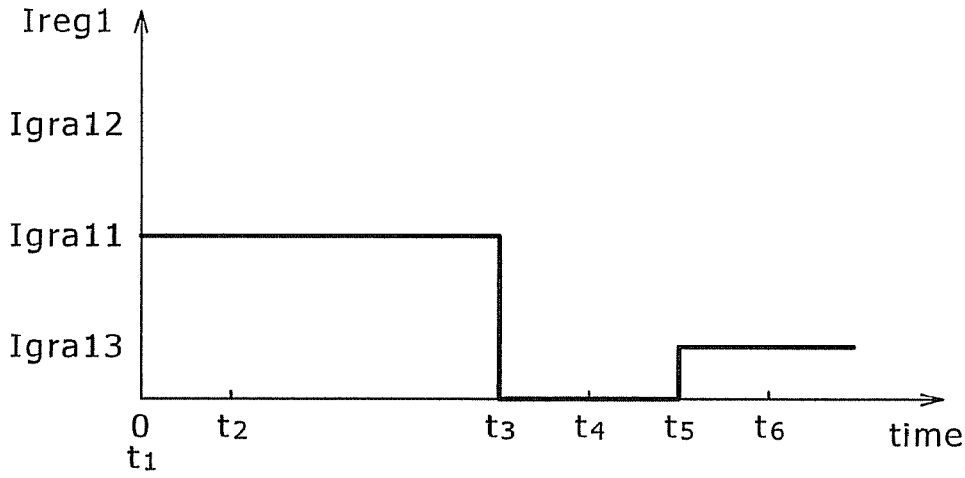
FIG. 5A is a diagram showing a characteristic of a first reference current (Ireg1) output from an arbitrary current circuit in the modified embodiment of the present invention.
Figure 5B:
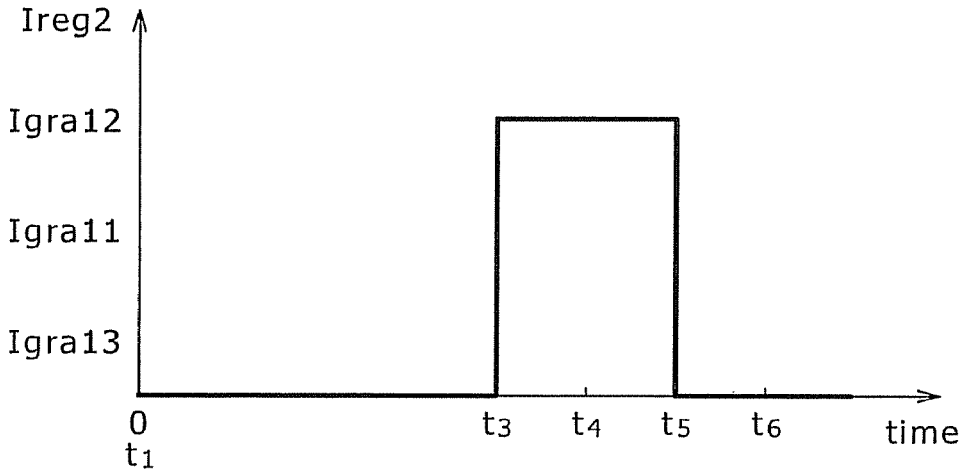
FIG. 5B is a diagram showing a characteristic of a second reference current (Ireg2) output from the arbitrary current circuit in the modified embodiment of the present invention.
Figure 6:
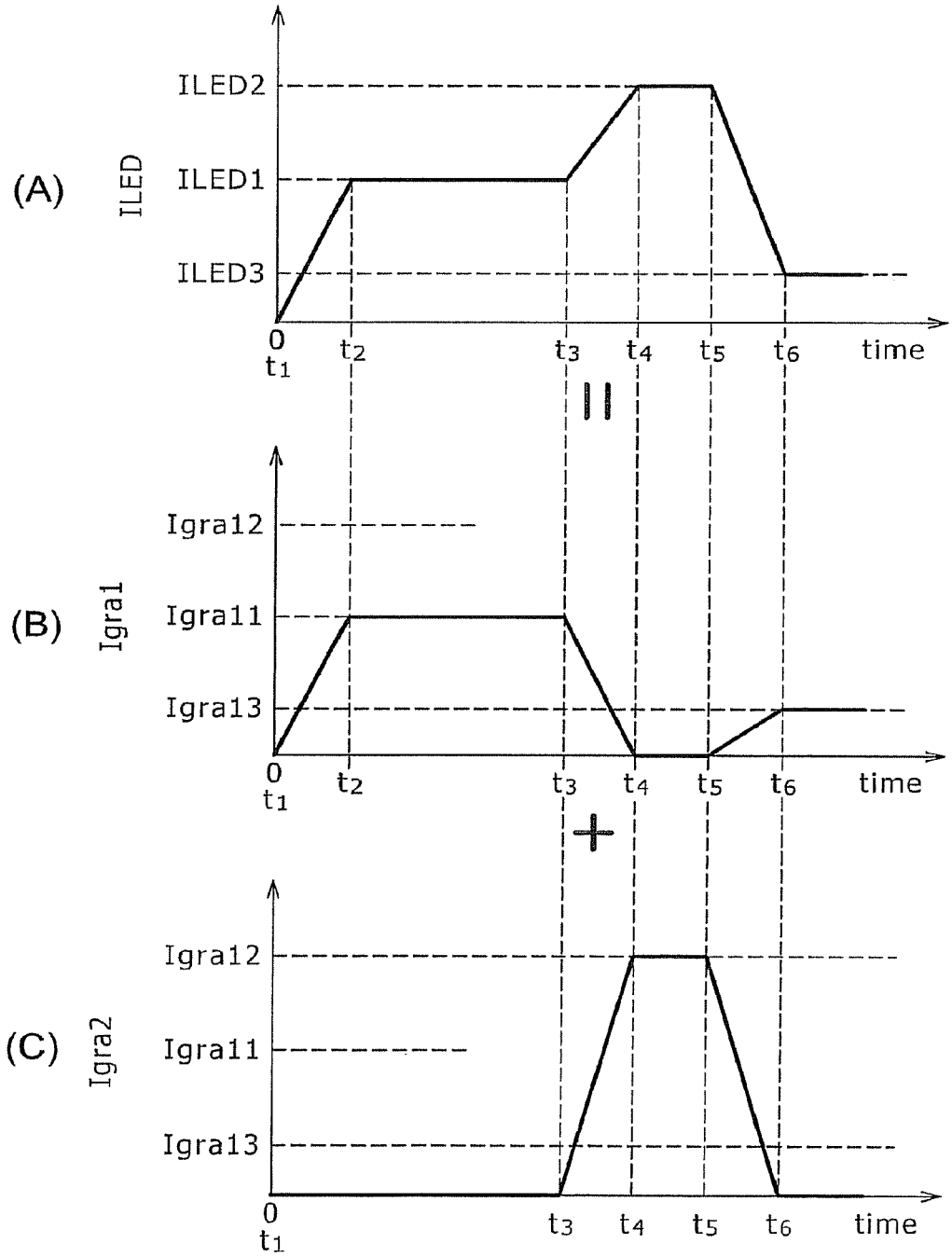
FIG. 6A is a diagram showing a characteristic of a light-emitting element drive current (ILED) output from an LED driver circuit in the modified embodiment of the present invention.
FIG. 6B is a diagram showing a characteristic of a first gradation current (Igra1) output from a gradation current circuit in the modified embodiment of the present invention.
FIG. 6C is a diagram showing the characteristic of the second gradation current (Igra2) output from a gradation current circuit in the modified embodiment of the present invention.
Figure 7:
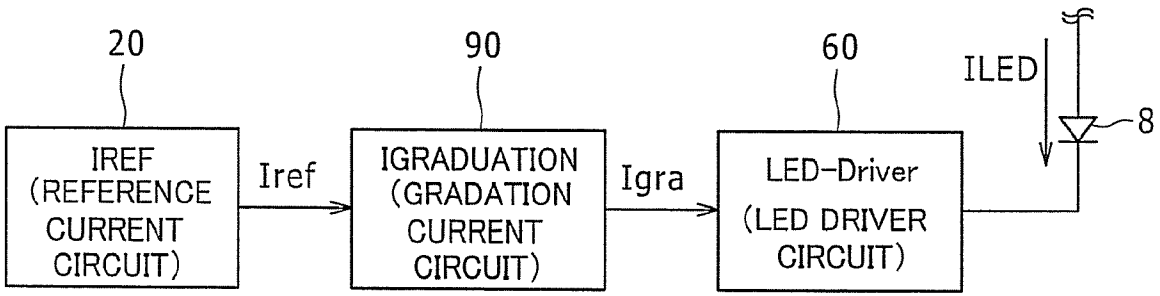
FIG. 7 is a diagram showing a light-emitting element drive circuit system according to conventional art.
Figure 8:
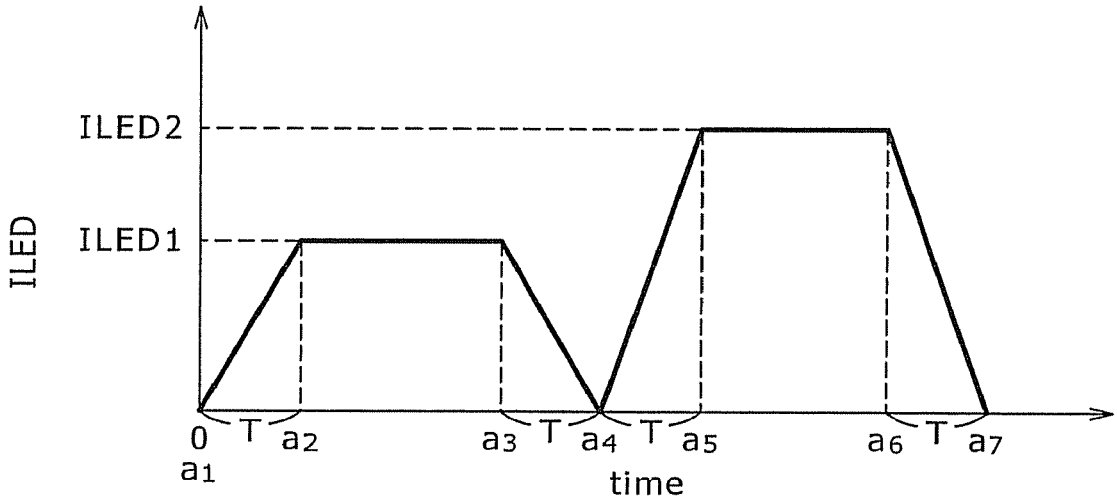
FIG. 8 is a diagram showing a characteristic of a light-emitting element drive current (ILED) according to conventional art.

FIG. 4 is a diagram showing the light-emitting element drive circuit system 11. FIG. 5A is a diagram showing a characteristic of a first reference current (Ireg1) output from the arbitrary current circuit 30. FIG. 5B is a diagram showing a characteristic of a second reference current (Ireg2) output from the arbitrary current circuit 30. FIG. 6A is a diagram showing a characteristic of a light-emitting element drive current (ILED) output from the LED driver circuit 60. FIG. 6B is a diagram showing a characteristic of a first gradation current (Igra1) output from the gradation current circuit 40. FIG. 6C is a diagram showing the characteristic of the second gradation current (Igra2) output from the gradation current circuit 80.

The arbitrary current circuit 30 outputs, based on the reference current (Iref) output from the reference current circuit 20, a first reference current (Ireg1) and a second reference current (Ireg2) shown in FIGS. 5A and 5B. In the first reference current (Ireg1), at time t1, the current value is changed from current value 0 (first current value) to a second current value (Igra11), and the second current value (Igra11) is maintained over the period from time t1 to time t3. Subsequently, at time t3, the current value is changed from the second current value (Igra11) to current value 0, and current value 0 is maintained from time t3 to time t5. Further, at time t5, the current value is changed from current value 0 to a sixth current value (Igra13), and the sixth current value (Igra13) is maintained from time t5 to time t6.

In the second reference current (Ireg2), current value 0 (first current value) is maintained over the period from time t1 to time t3, and, at time t3, the current value is changed from current value 0 to a third current value (Igra12). Subsequently, the third current value (Igra12) is maintained from time t3 to time t5, and, at time t5, the current value is changed from the third current value (Igra12) to current value 0. Further, current value 0 is maintained from time t5 to time t6.

The gradation current circuit 40 performs calculations based on the first reference current (Ireg1) according to the arithmetic expression Igra1=Agra1*Ireg1*m/n, where Agra1 is an arbitrary constant, n is a predefined natural number, and m is 0, 1, 2, . . . n (transition period T is divided into n sections), and outputs the first gradation current (Igra1) as shown in FIG. 6B. The first gradation current (Igra1) is such that, over the duration of the transition period T from time t1 to time t2, the current value is linearly changed from current value 0 (first current value) to the second current value (Igra11). From time t2 to time t3, the second current value (Igra11) is maintained. Subsequently, over the transition period T from time t3 to time t4, the current value is linearly changed from the second current value (Igra11) to current value 0, and current value 0 is maintained from time t4 to time t5. Further, over the transition period T from time t5 to time t6, the current value is linearly changed from current value 0 to the sixth current value (Igra13).

The gradation current circuit 80 performs calculations based on the second reference current (Ireg2) according to the arithmetic expression Igra2=Agra2*Ireg2*m/n, where Agra2 is an arbitrary constant, n is a predefined natural number, and m is 0, 1, 2, . . . n (transition period T is divided into n sections), and outputs the second gradation current (Igra2) as shown in FIG. 6C. The second gradation current (Igra2) is such that current value 0 (first current value) is maintained from time t1 to time t3, and, over the duration of the transition period T from time t3 to time t4, the current value is linearly changed from current value 0 to the third current value (Igra12). The third current value (Igra12) is maintained from time t4 to time t5. Further, over the transition period T from time t5 to time t6, the current value is linearly changed from the third current value (Igra12) to current value 0.

The LED driver circuit 60 is a current circuit section that calculates a light-emitting element drive current (ILED) (FIG. 6A) for driving the light-emitting element 8, based on a gradation current (Igra) that is output from the adder circuit 50 as a result of adding the first gradation current (Igra1) and the second gradation current (Igra2). The calculation is performed according to the arithmetic expression ILED=ALED*Igra, where ALED is an arbitrary constant. Here, the gradation current circuit 40 is referred to as "a first calculation circuit" that outputs the first gradation current (which is alternatively referred to as "first serial current-setting data"). The gradation current circuit 80 is referred to as "a second calculation circuit" that outputs the second gradation current (which is alternatively referred to as "second serial current-setting data"). Further, a combination of the gradation current circuit 40, the gradation current circuit 80, the arbitrary current circuit 30, and the adder circuit 50 is referred to as "a current value setting section."

According to the above-described light-emitting element drive circuit system 11, the light-emitting element drive current (ILED) output from the LED driver circuit 60 is as shown in FIG. 6A. Specifically, the light-emitting element drive current (ILED) is such that, over the period from time t1 to time t2, the current value is changed linearly from current value 0 to current value ILED1 (not equal to current value 0), and then current value ILED1 (not equal to zero) is maintained from time t2 to time t3. Further, over the period from time t3 to time t4, the current value is changed linearly from current value ILED1 (not equal to zero) to current value ILED2 (not equal to zero). In this manner, according to the light-emitting element drive circuit system 11, it is possible to linearly vary a current from an arbitrary current value to a different arbitrary current value. By means of such changes in the current value, the light-emitting element 8 can be caused to perform gradation emission, thereby enabling performance of gradation emission of light-emitting elements in a more desirable manner. It should be noted that, although the above explanation was made referring to embodiments in which the present invention is applied to an LED illumination, it is obvious that the present invention can also be applied to an LED backlight of an LCD screen and the like.

What is claimed is:

1. A light-emitting element drive circuit system for driving a light-emitting element, comprising: a current circuit section that drives the light-emitting element at a preset drive current value; and a current value setting section that sets the drive current value so that the drive current value is changed in a curve or linearly with a predetermined slope during a preset transition period from a first current value to a second current value that is not equal to the first current value, and changed in a curve or linearly with a predetermined slope during a preset transition period from the second current value to a third current value that is not equal to both the first current value and the second current value, wherein the current value setting section sets the drive current value so that the drive current value is changed from the first current value to the second current value during a preset transition period starting from a first time point, maintained at the second current value during a period from a second time point to a third time point, the second time point being a time point that occurs after elapse of the preset transition period from the first time point, and changed from the second current value to the third current value during a preset transition period starting from the third time point, wherein the current value setting section comprises: a first calculation circuit that outputs a first serial current-setting data having a current value that is changed from a first current value to a second current value during a period from the first time point to the second time point, changed from the second current value to the first current value at the second time point, maintained at the first current value during a period from the second time point to the third time point, changed, during a period from the third time point to a fourth time point, from the first current value to a fourth current value that is not equal to all of the first current value, the second current value, and a third current value, and changed from the fourth current value to the first current value at the fourth time point; a second calculation circuit that outputs a second serial current-setting data having a current value that is maintained at the first current value from the first time point to the second time point, changed from the first current value to the second current value at the second time point, maintained at the second current value from the second time point to the fourth time point, and changed from the second current value to the third current value at the fourth time point; and an adder circuit that serially adds together the first serial current-setting data for respective time points and the second serial current-setting data for corresponding time points.

2. A light-emitting element drive circuit system for driving a light-emitting element, comprising: a current circuit section that drives the light-emitting element at a preset drive current value; and a current value setting section that sets the drive current value so that the drive current value is changed in a curve or linearly with a predetermined slope during a preset transition period from a first current value to a second current value that is not equal to the first current value, and changed in a curve or linearly with a predetermined slope during a preset transition period from the second current value to a third current value that is not equal to both the first current value and the second current value, wherein the current value setting section sets the drive current value so that the drive current value is changed from the first current value to the second current value during a preset transition period starting from a first time point, maintained at the second current value during a period from a second time point to a third time point, the second time point being a time point that occurs after elapse of the preset transition period from the first time point, and changed from the second current value to the third current value during a preset transition period starting from the third time point, wherein the current value setting section comprises: a first calculation circuit that outputs a first serial current-setting data having a current value that is changed from a first current value to a second current value during a period from the first time point to the second time point, maintained at the second current value from the second time point to the third time point, and changed from the second current value to the first current value during a period from the third time point to a fourth time point; a second calculation circuit that outputs a second serial current-setting data having a current value that is maintained at the first current value from the first time point to the third time point, and changed from the first current value to a third current value during a period from the third time point to a fourth time point; and an adder circuit that serially adds together the first serial current-setting data for respective time points and the second serial current-setting data for corresponding time points.

3. An electronic device including the light-emitting element drive circuit system according to claim 1.

* * * * *